US005373717A

United States Patent [19]

Gore et al.

[11] Patent Number: 5,373,717

[45] Date of Patent: Dec. 20, 1994

[54] KEY RING SPLITTER

[75] Inventors: Douglas C. Gore, Long Beach; Raymond A. Lofredo, San Diego, both of Calif.

[73] Assignee: Douglas C. Gore, Long Beach, Calif.

[21] Appl. No.: 120,078

[22] Filed: Sep. 13, 1993

[51] Int. Cl.[5] ..... A44B 15/00; B25B 33/00

[52] U.S. Cl. ..... 70/456 R; 7/170; 70/458

[58] Field of Search ..... 70/456 R, 457–460; D3/207, 208, 210; 24/3 K; 81/485; 7/170

[56] References Cited

U.S. PATENT DOCUMENTS 4,325,273 4/1982 Gibbons .
4,543,860 10/1985 Van Meter ..... 70/456 R X
4,706,477 11/1987 Rousseau ..... 70/456 R
4,719,778 1/1988 Murphy et al. ..... 70/456 R
4,790,161 12/1988 Dick ..... 70/458 X

*Primary Examiner*—Lloyd A. Gall
*Attorney, Agent, or Firm*—Thomas I. Rozsa; Tony D. Chen

[57] ABSTRACT

The present invention is a key ring splitter for separating an end of a conventional key ring so as to locate keys thereon or also remove keys. The present invention utilizes a pulling motion to separate the key ring instead of a pushing motion and also includes a self-alignment feature. The key ring splitter includes a front section with a front end and a rear section with a rear end. The front section is provided with a small rectangular shaped opening which is defined by an upper edge, a lower edge, a proximal edge adjacent to the front end, and an opposite distal edge.

10 Claims, 1 Drawing Sheet

KEY RING SPLITTER

BACKGROUND OF THE INVENTION

1. Field of The Invention

The present invention relates to the field of key rings. In particular, the present invention is a key ring splitter for separating a collapsed helical key ring.

2. Description of The Prior Art

A conventional key ring is often constructed of a collapsed helical coil which is wound in an overall circular pattern. It is normally difficult for a user to separate an end of the key ring by using his or her fingernails in order to put keys thereon or also remove keys. Frequently, the key ring will snap back together before one gets a chance to slip a key onto the key ring. Also, men frequently do not have fingernails of length to be readily utilized to facilitate the desired separation of the end of the key ring. Furthermore, women can easily damage their nails in separating a key ring.

In the prior art, there are many different types of key ring separators. These key ring separators have two common problems. First, they require hand-eye coordination which is difficult for elderly people with arthritis or other problems with their hands. Secondly, the pointed end of the key ring separator is pushed against the key ring members to separate them. If it is not done correctly, users can injure themselves by accidentally pricking themselves with the pointed end of the key ring separator.

The following four (4) prior art patents were uncovered in the pertinent field of the present invention.

1. U.S. Pat. No. 4,325,273 issued to Gibbons on Apr. 20, 1982 for "Opener For Split Ring Key Holder" (hereafter "the Gibbons Patent").

2. U.S. Pat. No. 4,543,860 issued to Van Meter on Oct. 1, 1985 for "Key Ring Attachment" (hereafter "the Van Meter Patent").

3. U.S. Pat. No. 4,706,477 issued to Rousseau on Nov. 17, 1987 for "Key Ring Type Device" (hereafter "the Rousseau Patent").

4. U.S. Pat. No. 4,719,778 issued to Murphy et al. on Jan. 19, 1988 for "Key Ring Separator" (hereafter "the Murphy Patent").

The Gibbons Patent discloses an opener for splitting a ring key holder. The Gibbons' device has a large opening which extends substantially all the way across the handle and a shank which is short so that the length along the shank from the opening to the top of the tool bit is less than the internal diameter of the key ring. The tool bit comprises a forwardly projecting wedge based on the shank. In operation, the device is mounted on the key ring and the user moves the device back enough to permit the point of the opening wedge to be brought within the central opening. The point is pushed outwards thus parting the surfaces of the ring.

The Van Meter Patent discloses a key ring attachment. The attachment comprises an enlarged body section which is rectangular in configuration. A protrusion is integrally attached to the enlarged body section. In operating the attachment, the user grasps the enlarged body section and positions the sharpened edge of the protrusion in contact with the key ring. The user exerts a pushing motion which wedges the protrusion between the abutting ring shaped members of the key ring which causes the ends to be slightly spaced from its abutting ring.

The Rousseau Patent discloses a key ring. It includes an accessory part which is flat in shape and has two parallel flat wings, one end of which defines a pair of circular openings for a hook ring. The user applies a pushing motion which wedges a tool component between two members of a ring to where they can be separated. The accessory part also includes a guard band which encloses the tool component.

The Murphy Patent discloses a key ring separator. The device includes a cut-out in the surface of a key handle to form a pointed ring separator shaped triangular projection within a ring opening of the key. The user applies a pushing motion so that the pointed ring separator separates the collapsed coil sections of the ring.

It can be seen that various key ring separators have been utilized in the prior art. However, all of these devices utilize hand-eye coordination to separate the collapsed coil sections of the ring. In addition, all of these patents utilize a pushing motion to separate the coil sections of the ring wherein the user is pushing a pointed object from the hand toward the user's other hand while separating the key ring loops.

Therefore, it is highly desirable to eliminate the need for precise hand-eye coordination to separate the collapsed coil sections of the ring, and also use a pulling motion instead of a pushing motion so that users cannot injure themselves.

SUMMARY OF THE INVENTION

The present invention is a key ring splitter for separating an end of a key ring so that keys can be placed thereon or also removed therefrom.

The present invention is a novel and unique key ring splitter which utilizes a pulling motion to separate the key ring instead of a pushing motion and also includes a self-alignment feature.

It has been discovered, according to the present invention, that by utilizing a shank with an acute angle blade end on a key ring splitter, it will provide a self-alignment feature without requiring hand-eye coordination.

It has further been discovered, according to the present invention, that by utilizing the key ring splitter, it will only need a pulling motion to separate an end of the key ring apart instead of a pushing motion.

It is therefore an object of the present invention to provide a key ring splitter for separating an end of the key ring.

It is also an object of the present invention to provide a key ring splitter with a self-alignment feature, so that hand-eye coordination is not required.

It is an additional object of the present invention to provide a key ring splitter which is to be utilized in conjunction with a key ring and can be readily connected and also which is small in size to therefore occupy a small amount of space and not interfere with the normal operating and carrying of the key ring.

It is a further object of the present invention to provide a key ring splitter which utilizes a pulling motion, so that a user will not injure himself or herself.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention provides a key ring splitter which is to be utilized in conjunction with a key ring and can be readily connected to the key ring. The present invention is also small in size to therefore occupy a small amount of space and does not interfere with the normal operating and carrying of the key ring.

Figure 1:
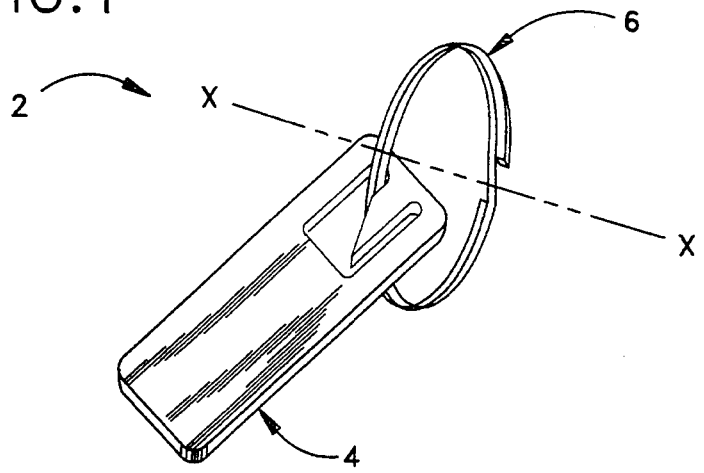
FIG. 1 is a perspective view of the preferred embodiment of the present invention key ring splitter with a conventional key ring.

Referring to FIG. 1, there is shown at 2 the present invention apparatus which includes a key ring splitter 4 and a conventional circular key ring 6. The circular key ring 6 comprises two collapsed coils 8 and 10 (see FIG. 2) that can be drawn apart along a direction parallel to the axis X of the two collapsed coils 8 and 10 so as to allow the insertion of a key (not shown). The key ring splitter 4 is inserted upon and hangs from the circular key ring 6.

Figure 2:
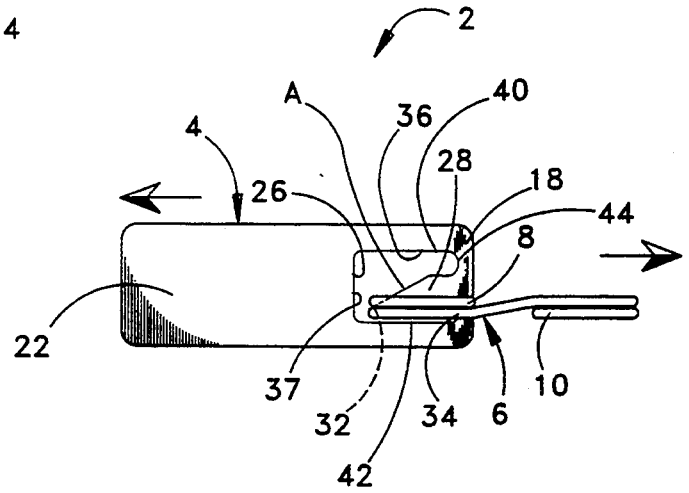
FIG. 2 is a top plan view showing the self-alignment feature of the present invention key ring splitter.

Referring to FIG. 2, the key ring splitter 4 is generally an elongated flat rectangular shaped body which is utilized to facilitate the separation of the two collapsed coils 8 and 10 of the key ring 6. The key ring splitter 4 includes a front section 18 with a front end and a rear section 22 with a rear end. The front section 18 is provided with a small rectangular shaped opening 26 therethrough. The small rectangular shaped opening 26 is defined by an upper edge 40, a lower edge 42, a proximal edge 44 adjacent to the front end, and an opposite distal edge 37.

It will be appreciated that the key ring splitter 4 is not limited to the rectangular shape. It is emphasized that while the rectangular configuration is the preferred embodiment, it is also within the spirit and scope of the present invention to have a circular shaped body or a multiplicity of configurations.

Figure 3:
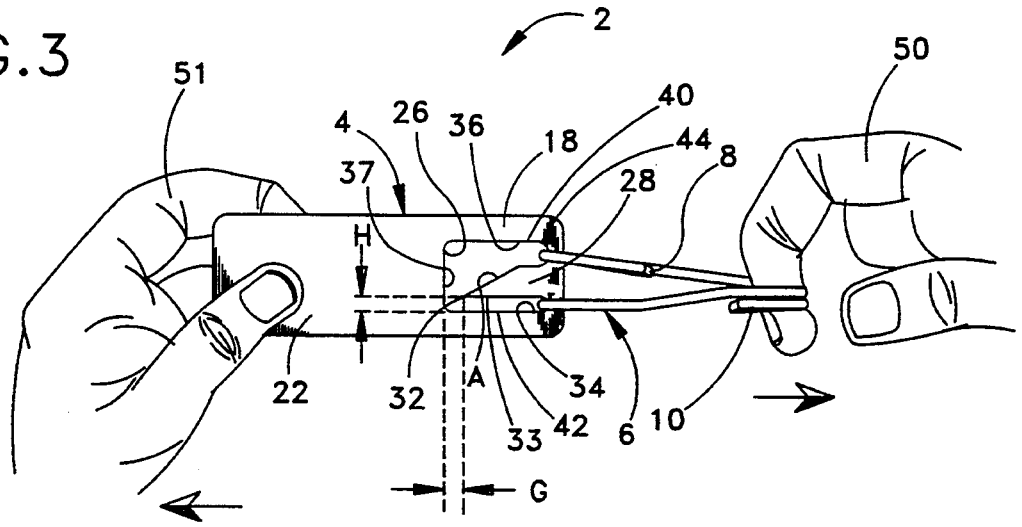
FIG. 3 is a top plan view of the present invention key ring splitter, illustrating the pulling motion to separate the key ring.

Referring to FIG. 3, there is shown a flat shank 28 which is integrally attached to the front end of the front section 18 and projects rearwardly into the small rectangular opening 26. The flat shank 28 has a first end which forms an acute angle blade 32 or equivalent, to draw the two collapsed coils 8 and 10 apart. The acute angle blade 32 has a sharp tip, an upper inclined edge A, and a lower edge 33 which is parallel to the lower edge 42 of the small opening 26. Two narrow channels are formed between the flat shank 28 and the edges of the opening 26. A first channel 34 is formed between the lower edge 33 of shank 28 and the lower edge 42 of opening 26. A second channel 36 is formed between the inclined edge A of shank 28 and the upper edge 40 of opening 26. The sharp tip of the acute angle blade 32 maintains a distance G from the distal edge 37 of the small opening 26, such that the key ring 6 can slide down on the upper inclined edge A of the acute angle blade 32 and rests at a corner defined by the distal edge 37 and lower edge 42 of the small opening between the sharp tip of the acute angle blade 32 and the distal edge 37 of the small opening 26. The narrow channel 34 has a width H which is less than the total thickness of the two collapsed coils 8, 10 of the key ring 6 but greater than the thickness of a single one of the two collapsed coils 8 and 10.

By way of example, the angle of the upper inclined edge A of the acute angle blade 32 of the flat shank 28 is preferably 30°. It will be appreciated that the angle described above is merely one illustrative embodiment and can include many other comparable sets of angles. It is also within the spirit and scope of the present invention to have the angle of the upper inclined edge A of the acute angle blade 32 set within the approximate range of 12° to 45° to be operable.

In operation, the key ring 6 slides down on the upper inclined edge A of the flat shank 28 such that the key ring 6 is pulled against the sharp tip of the acute angle blade 32 and the two collapsed coils 8 and 10 are self-aligned with the acute angle blade 32 of the flat shank 28, as shown in FIG. 2. The key ring 6 is then pulled with the right hand 50 or the left hand 51 of a person, as shown in FIG. 3, to engage with the acute angle blade 32 of the flat shank 28. The two collapsed coils 8, 10 will be separated by the sharp tip of the acute angle blade 32 and only one of the two collapsed coils 8, 10 can slide through the narrow channel 34 which acts as a guide, so that the two collapsed coils 8, 10 are separated by the flat shank 28 for allowing the insertion of the key, as shown in FIG. 3.

One of the unique features of the present invention key ring splitter 4 is that the user utilizes a pulling motion instead of a pushing motion to separate the two collapsed coils 8 and 10 apart, as shown in FIG. 3, so that he or she will not injure himself or herself from the sharp tip of the acute angle blade 32.

Another unique feature of the key ring splitter 4 is the self-alignment feature, as shown in FIG. 2, so that hand-eye coordination is not required in separating the two collapsed coils 8 and 10 apart. The self-alignment feature utilizes the distal edge 37 and the upper inclined edge A of the acute angle blade 32 to create a funneling action or effect which makes this unique in the present invention.

The key ring splitter 4 can be made from several materials. The manufacturing process which could accommodate the construction of the key ring splitter 4 may be injection, thermoform, etc. or other molding process. By way of example, the elongated flat rectangular shaped body of the key ring splitter 4 is preferably made of T-6 aluminum material or other suitable materials such as plastic. The molding and mass production process would enable the key ring splitter 4 to be produced inexpensively.

The key ring splitter 4 can be manufactured with or without the conventional key ring 6. The key ring splitter 4 can be adapted to any conventional key ring.

The present invention has many advantageous features including: (a) it has a self-alignment feature; (b) it utilizes a pulling motion instead of a pushing motion; and (c) the sharp tip of the acute angle blade is shielded within the small rectangular opening to protect the user from injury.

Defined in detail, the present invention is a key ring splitter, comprising: (a) a circular key ring having two collapsed coils that can be drawn apart along a direction parallel to the axis of the two collapsed coils so as to allow the insertion of keys; (b) a generally elongated flat rectangular shaped body having a front section with a front end; (c) said front section of said elongated flat rectangular shaped body having a small rectangular shaped opening therethrough with the key ring extending through the opening, where the small opening is defined by an upper edge, a lower edge, a proximal edge adjacent to said front end, and an opposite distal edge; (d) a flat shank integrally attached to said proximal edge of said small opening and having one end which forms an acute angle blade, the flat shank projecting rearwardly from said proximal edge into said small rectangular shaped opening, the acute angle blade having a sharp tip pointing toward said distal edge of said rectangular shaped opening, an upper inclined edge, and a straight lower edge which is parallel to said lower edge of said small rectangular shaped opening so that a narrow channel is formed between the straight lower edge of the acute angle blade and the lower edge of said small rectangular shaped opening; (e) said sharp tip of said acute angle blade maintains a distance from said distal edge of said small opening, such that said key ring can slide down on said upper inclined edge of said acute angle blade and rest at a corner defined by said distal edge and the lower edge of said small rectangular shaped opening between said sharp tip of said acute angle blade and said distal edge of said small rectangular shaped opening; and (f) said narrow channel having a width less than the total thickness of said two collapsed coils of said key ring but greater that a thickness of a single one of said two collapsed coils of said key ring; (g) whereby when said key ring is pulled against said sharp tip of said acute angle blade, said two collapsed coils will be separated by said sharp tip and only one of said two collapsed coils can slide through said narrow channel which acts as a guide, so that said two collapsed coils are separated by said flat shank for allowing the insertion of keys on said key ring.

Defined broadly, the present invention is a key ring splitter for separating a key ring apart, the key ring having two collapsed coils that can be drawn apart along a direction parallel to the axis of the two collapsed coils for allowing the insertion of keys, the key ring splitter comprising: (a) a body having a front section with a front end; (b) said front section of said body having an opening therethrough with the key ring extending through the opening, and where the opening is defined by four edges; (c) a shank having an acute blade end which projects rearwardly from said front end of said body into said opening, the acute blade end having an upper inclined edge, and a straight lower edge which is parallel to a respective one of said four edges of said opening such that a narrow channel is formed between the straight lower edge of the shank and the edge of the opening; (d) said acute blade end maintains a distance from a respective one of said four edges of said opening, such that said key ring can slide down on said upper inclined edge of said acute blade end and rest at a corner defined by a respective one of said four edges of said opening between said acute blade end and said respective one of said four edges of said opening; and (e) said narrow channel having a width less than the total thickness of said two collapsed coils of said key ring but greater than the thickness of a single one of said two collapsed coils of said key ring; (f) whereby when said key ring is pulled against said acute blade end, said two collapsed coils will be separated by said acute blade end and only one of said two collapsed coils can slide through said narrow channel which acts as a guide, so that said two collapsed coils are separated by said shank for allowing the insertion of said keys on said key ring.

Defined more broadly, the present invention is a splitter for separating a key ring, comprising: (a) a body member having a front section with an opening therethrough having a first one straight edge, the key ring extending through the opening; and (b) a shank having a blade end which projects rearwardly from said front section of said body member into said opening and a lower straight edge, thereby forming a channel between the lower straight edge of the shank and at least one straight edge of the opening; (c) whereby when said key ring is pulled against said blade end of said shank, said key ring will be separated by said blade end and said channel which acts as a guide, so that said key ring is separated by said shank for allowing the insertion of keys on said key ring.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A splitter for separating a key ring having at least two collapsed coils, comprising:

a. a body member having a front section with an opening therethrough having at least one straight edge, the key ring extending through the opening;

b. a shank having a blade end which projects rearwardly from said front section of said body member into said opening and a lower straight edge, thereby forming a channel between the lower straight edge of the shank and at least one straight edge of the opening, where the channel has a width less than the total thickness of two collapsed coils of said key ring but greater than the thickness of a single one of the two collapsed coils of said key ring; and c. said key ring pulled against said blade end of said shank such that said key ring will be separated by said blade end and said channel which acts as a guide, so that said key ring is separated by said shank for allowing the insertion of keys on said key ring.

2. The splitter as defined in claim 1 wherein said splitter is made of aluminum.

3. The splitter as defined in claim 1 wherein said blade end of said shank has an acute angle of 30°.

4. The splitter as defined in claim 1 wherein said blade end of said shank has an acute angle approximately in the range of 12° to 45°.

5. A key ring splitter, comprising:

a. a circular key ring having two collapsed coils that can be drawn apart along a direction parallel to the axis of the two collapsed coils so as to allow the insertion of keys;

b. a generally elongated flat rectangular shaped body having a front section with a front end;

c. said front section of said elongated flat rectangular shaped body having a small rectangular shaped opening therethrough with the key ring extending through the opening, where the small opening is defined by an upper edge, a lower edge, a proximal edge adjacent to said front end, and an opposite distal edge;

d. a flat shank integrally attached to said proximal edge of said small opening and having one end which forms an acute angle blade, the flat shank projecting rearwardly from said proximal edge into said small rectangular shaped opening, the acute angle blade having a sharp tip pointing toward said distal edge of said rectangular shaped opening, an upper inclined edge, and a straight lower edge which is parallel to said lower edge of said small rectangular shaped opening so that a narrow channel is formed between the straight lower edge of the acute angle blade and the lower edge of said small rectangular shaped opening;

e. said sharp tip of said acute angle blade maintains a distance from said distal edge of said small opening, such that said key ring can slide down on said upper inclined edge of said acute angle blade and rest at a corner defined by said distal edge and the lower edge of said small rectangular shaped opening between said sharp tip of said acute angle blade and said distal edge of said small rectangular shaped opening; and f. said narrow channel having a width less than the total thickness of said two collapsed coils of said key ring but greater that a thickness of a single one of said two collapsed coils of said key ring;

g. whereby when said key ring is pulled against said sharp tip of said acute angle blade, said two collapsed coils will be separated by said sharp tip and only one of said two collapsed coils can slide through said narrow channel which acts as a guide, so that said two collapsed coils are separated by said flat shank for allowing the insertion of keys on said key ring.

6. The key ring splitter as defined in claim 5 wherein said key ring splitter is made of T-6 aluminum.

7. The key ring splitter as defined in claim 5 wherein said acute angle blade of said flat shank is approximately at an angle of 30°.

8. A key ring splitter for separating a key ring apart, the key ring having two collapsed coils that can be drawn apart along a direction parallel to the axis of the two collapsed coils for allowing the insertion of keys, the key ring splitter comprising:

a. a body having a front section with a front end;

b. said front section of said body having an opening therethrough, with the key ring extending through the opening, and where the opening is defined by four edges;

c. a shank having an acute blade end which projects rearwardly from said front end of said body into said opening, the acute blade end having an upper inclined edge, and a straight lower edge which is parallel to a respective one of said four edges of said opening such that a narrow channel is formed between the straight lower edge of the shank and the edge of the opening;

d. said acute blade end maintains a distance from a respective one of said four edges of said opening, such that said key ring can slide down on said upper inclined edge of said acute blade end and rest at a corner defined by a respective one of said four edges of said opening between said acute blade end and said respective one of said four edges of said opening; and e. said narrow channel having a width less than the total thickness of said two collapsed coils of said key ring but greater than the thickness of a single one of said two collapsed coils of said key ring;

f. whereby when said key ring is pulled against said acute blade end, said two collapsed coils will be separated by said acute blade end and only one of said two collapsed coils can slide through said narrow channel which acts as a guide, so that said two collapsed coils are separated by said shank for allowing the insertion of said keys on said key ring.

9. The key ring splitter as defined in claim 8 wherein said key ring splitter is made of aluminum.

10. The key ring splitter as defined in claim 8 wherein said acute blade end of said shank is approximately in the range of 12° to 45°.

* * * * *